US006283351B1

(12) United States Patent
Brite

(10) Patent No.: US 6,283,351 B1
(45) Date of Patent: Sep. 4, 2001

(54) UNIVERSAL BELT SUPPORTED CARRIER FOR HANDGUNS

(76) Inventor: Ray M. Brite, 9915 Tallow Tree Cir., Houston, TX (US) 77070

( * ) Notice: Subject to any disclaimer, the term of this patent is extended or adjusted under 35 U.S.C. 154(b) by 0 days.

(21) Appl. No.: 09/127,950

(22) Filed: Jul. 29, 1998

Related U.S. Application Data

(60) Provisional application No. 60/054,247, filed on Jul. 30, 1997.

(51) Int. Cl.[7] ..... F41C 33/02

(52) U.S. Cl. ..... 224/673; 224/238; 224/243; 224/911

(58) Field of Search ..... 224/911, 673, 224/238, 243

(56) References Cited

U.S. PATENT DOCUMENTS 3,731,858 * 5/1973 Baker ..... 224/911
4,544,089 * 10/1985 Tabler ..... 224/911
4,759,482 * 7/1988 Olsen ..... 224/911

* cited by examiner

*Primary Examiner*—Stephen P. Garbe
(74) *Attorney, Agent, or Firm*—James L. Jackson; Mayor, Day, Caldwell & Keeton, LLP

(57) ABSTRACT

A universal handgun carrying system, more commonly known as a holster, is provided for waist belt support, for positioning and carrying both semi-automatic and revolver type handguns. Inside and outside sheet-like panel members composed of leather or other suitable material are joined only at the front, so as to provide a universal holster assembly having an open rear portion that is closed by the waist belt of the user. Each of the inner and outer panels defines a body section having a pair of belt slots, with the front belt slots of both panels in registry and with the rear belt slots offset from one another. Projections, being preferably integral with the body sections, extend upwardly from the inner and outer panels and are provided with fastening devices such as snaps. One of the projections defines a retention strap and is adapted to be bent over the upper portion of a handgun to secure the handgun within the holster. The holster assembly utilizes the waist belt of the user and the mass or weight of the handgun in integrated relation with the inner and outer panels to provide for efficient positioning and secure retention of the handgun.

20 Claims, 3 Drawing Sheets

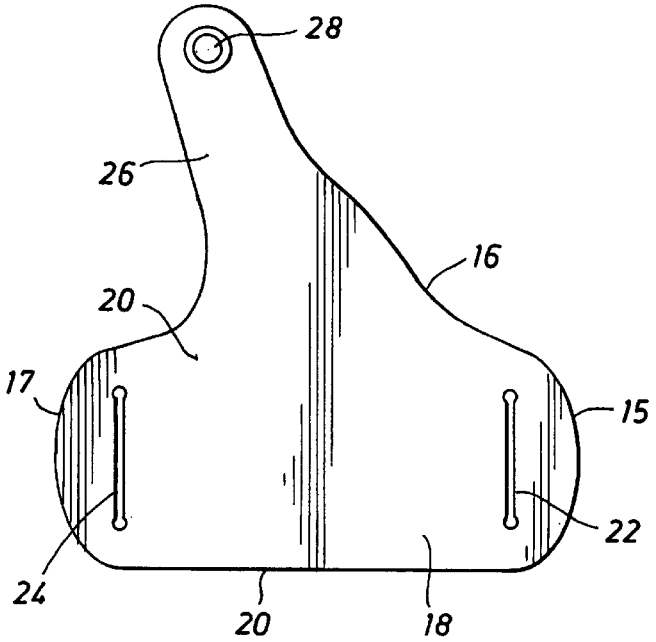
FIG. 3
FIG. 4
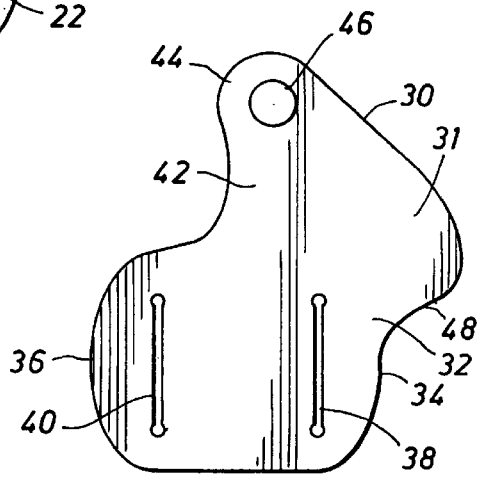
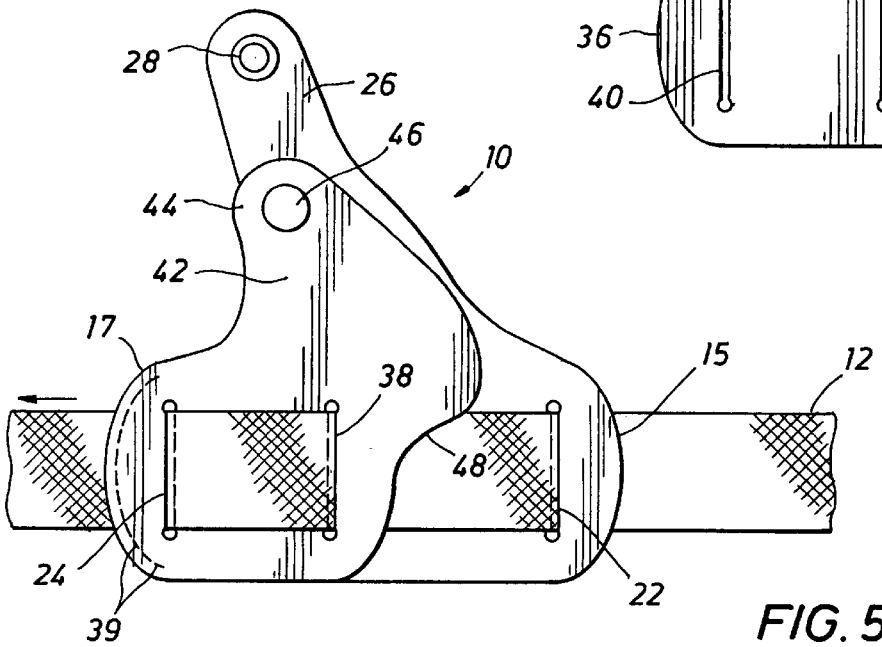
FIG. 5

FIG. 6
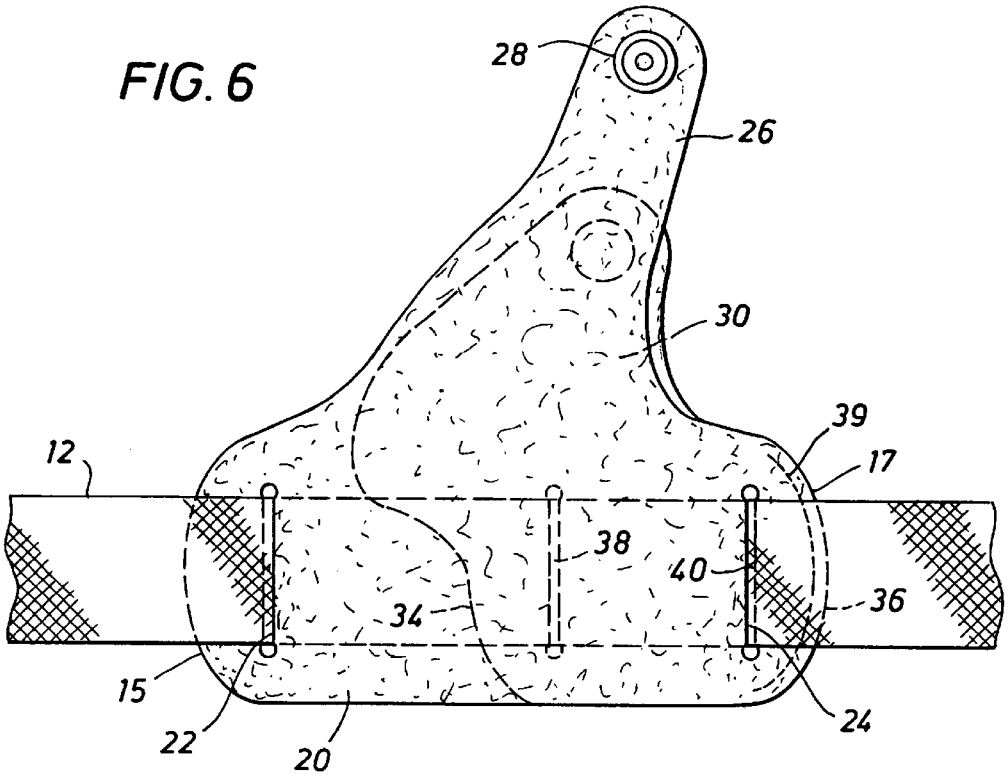
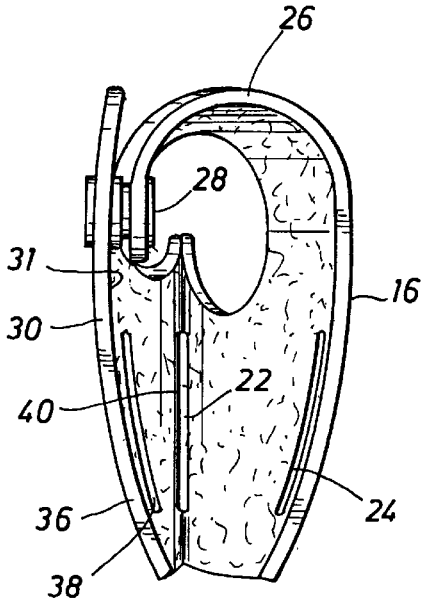
FIG. 7

UNIVERSAL BELT SUPPORTED CARRIER FOR HANDGUNS

The benefit of United States Provisional Application Ser. No. 60/054,247, filed on Jul. 30, 1997 by Ray M. Brite and entitled Universal Handgun Holster is hereby claimed.

BACKGROUND OF THE INVENTION

1. Field of the Invention

This invention relates generally to handgun holsters and more particularly concerns a universal handgun carrying system, more commonly known as a holster, being designed for user waist belt support for positioning and support of a wide variety of both semi-automatic and revolver type handgun frame designs. Even further, the present invention enables waist belt support and positioning of some types of rifles and shotguns.

2. Description of the Prior Art

Handguns are provided in two general configurations, revolver type and semi-automatic type handguns. These handgun types are significantly different and generally require separate types of holsters for adequate gun support and efficiency of gun insertion, transportation and extraction. At the present time, except for the sporting firearm industry, handguns are carried by waist belt supported holsters by law enforcement personnel who typically require holsters that permit the handgun, regardless of its type, to be quickly and efficiently extracted from a holster or inserted into a holster. Such personnel also typically require the handgun to be securely retained within the holster to permit running, jumping, entering and leaving automobile vehicles without risk of the handgun inadvertently becoming separated from the holster. Law enforcement personnel also typically require handguns to be secured within holsters in a manner that it is difficult for another person to remove the handgun from the holster without difficulty. Since revolver type handguns typically fit only one type of handgun holster and semi-automatic type handguns typically only a single type of holster, a wide variety of holster designs have been developed. Accordingly, it is desirable to provide a universal handgun holster that can provide effective support for both revolver and semi-automatic types of handguns and to provide stable and efficient support therefor. It is also desirable to provide a handgun holster having the capability for securing a handgun therein in a manner that the handgun is readily available for simple and efficient removal from the holster by the user, but is extremely difficult to remove from the holster by force. It is also desirable to provide a handgun holster that positions a handgun, regardless of its type, for stable and efficient carrying by the user, even while strenuous exercise or body movement occurs.

Almost all handgun carriers (holsters) are made of two pieces of leather, one on the inside sewn or glued to a piece on the outside, between which the handgun is carried. Most are configured to fit only a particular brand, style, or model number and no others. Many of these are molded to fit exactly the contours of a particular handgun. Because of the full layer(s) of leather between the handgun and the body of the wearer, many protrude outward from the body of the wearer, making the handgun less concealable, a major factor with law enforcement agencies and officers. Also, the further away from the body the frame extends, the accessibility to the gun by others is increased.

This invention is unique in that heretofore a holster was considered to be something which, because it was an item totally separate and apart from the wearer's clothing, had to be constructed and functionally separate as well.

Virtually all handgun holsters previously have been designed to have two separate panels of material, sewn together at opposing ends, or one piece of material "wrapped around" or folded and sewn together, to form a pocket or pouch into which a handgun was placed. The pouch of the holster is typically created when the two separate panels of material are placed one on top of the other. Then along a vertical line at each end of the material and within the outer perimeter of the material the panels of material are typically stitched together. Then between that line of stitching and the ends is typically cut a belt slot through which the wearer would lace a waist belt to provide support for the holster. The resulting holster configuration can best be described as an envelope with handles.

On "wrap around" holster designs a single piece of material is typically attached at the upper edge of the holster and folded back of the holster pouch and then sewn to a point on the upper edge or lower part of the back of the holster to form one large vertical loop of holster material through which the waist belt of the wearer is threaded. This resulting design causes the holster to hang on the waist belt of the user in a very haphazard and loose manner and thus allows significant movement of the holster and handgun. Even more critical, this "wrap around" type of holster permits the handgun to become angled outwardly, away from the body of the user, and thus makes the handgun vulnerable to being forcibly removed from the holster without authorization.

Because of the physics of these designs of construction, although the wearer tightens the waist belt securely, the center of the holster, where the weight of the handgun is, is not fastened or secured and therefore has a tendency to flop outwardly, away from the wearer's body. In doing so the butt and upper frame of the handgun are exposed to others in a manner which makes it easy for an adversary to jerk the weapon from the holster, even when a securing device is in place.

Likewise, almost all holsters have belt slits which are from one and one fourth, to two inches in length, through which the wearer laces a waist belt. If the wearer uses a belt of smaller width than the length of the slits in the holster, the resulting open, or excess, space in the slits allows the holster to rock up and down loosely on the belt and allows the outward flop of the holster and handgun to be exaggerated because of the slack. Likewise the resulting slack allows the holster to "walk" or move forwards and backwards on the wearer's belt rather than remaining in the place the wearer wishes it to remain. This problem can cause the holster and handgun to become mispositioned to the point that it becomes difficult for the user to access the handgun.

For a holster to work properly, there should always be a belt loop on the wearer's apparel which should be integrated into the lacing of the holster on the belt. This secures it in place when the handgun is withdrawn from the holster. Because clothing manufacturers do not have a standardization of where the belt loops on their garments are sewn, quite often the wearer has to wear the holster too far forward or backward of the desired positioning in order to take advantage of the proper lacing of the holster onto the belt.

SUMMARY OF THE INVENTION

It is a primary feature of the present invention to provide a novel universal handgun carrier or holster that provides efficient support for handguns, regardless whether the handgun is of the revolver or semi-automatic type;

It is another feature of the present invention to provide a novel universal handgun carrier or holster having the capability for support of a semi-automatic or revolver type handgun in a position close to the body of the user and to provide secure retention of the handgun, to thus minimize the potential for removal of the handgun from the holster by others;

It is an even further feature of the present invention to provide a novel universal handgun carrier or holster wherein the waist belt of the user functions, in addition to providing support of the holster and handgun, to provide a closure for an open end of the holster and to provide for support of the handgun within the holster;

It is also a feature of the present invention to provide a novel universal handgun carrier or holster wherein the weight or mass of the handgun functions in concert with the holster construction, the wearer's waist belt and the wearer's apparel belt loops to provide for efficient positioning and support of the handgun;

Briefly, the unique design of the handgun holster of the present invention incorporates a panel of leather or other sheet-like material that is suitable for the intended purpose and which forms the outer side of the holster. This outer panel is provided with integrated belt loops on each end which holds the holster in place on the wearer's belt. On the top portion of the front panel of the holster is an upwardly extending elongate protrusion which, when flexed, arches over the back/top, or hammer, of the handgun and assists in holding the handgun securely in the holster, even while the user is running and/or jumping, getting into or out of an automotive vehicle or doing other unusual activity. Affixed to this upstanding protrusion is the "female" or receiving half of a snap type fastener device. The part of the upstanding protrusion that faces outward, when the protrusion is bent over the upper portion of the handgun, aligns with the "female" or receiving half part of a snap type fastener device which is affixed into the back panel of the holster. The back panel of the holster consists of a panel of leather or other suitable material that is approximately one third the length of the outer side. This panel also has integrated belt loops on each end. Near the rear of the back panel is a raised, upward protrusion of leather which contains the female or receiver half part of the snap type fastener device. When this panel and the panel containing the male part of the snap located on the front part of the holster are joined together by the snap-type fastener or any other suitable fastening means they form an arch over the back of the handgun, this fastening means being known as the thumb-break safety, so called because the wearer may insert a thumb between the two retention pieces, causing the snap elements of the snap type fastener to separate, thus releasing the gun and allowing it to be removed from the holster. A unique feature of this design is that the front belt loop slots on the outer and inner layers of leather are sewn together as one belt slot. The rearward belt loop of the inside and outer layers are not sewn together. This results in the inside part of the holster being much shorter than the outside. Another unique feature of this invention is that the belt of the user functions as a closure for a part of the open rear portion of the holster and becomes a component that assists the inner and outer panels and the retention strap in positioning and securing the handgun.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is an elevational view of a universal handgun holster that is constructed in accordance with the present invention and represents the preferred embodiment and showing a semi-automatic type handgun secured thereby, the handgun being shown in broken line;

FIG. 2 is an elevational view of the universal handgun holster of FIG. 1 and showing a revolver type handgun secured thereby, the handgun being shown in broken line;

FIG. 3 a side elevational view of the outer side panel of the holster as cut from leather or other suitable material and unassembled;

FIG. 4 is a side elevational view of the inner side panel of the holster as cut from leather or other suitable material and unassembled;

FIG. 5 is a side elevational view, from the inside of the holster assembly, showing the inner and outer panels of the holster assembled together in completed form and showing the waist belt of the user in assembly therewith;

FIG. 6 is a side elevational view, from the outer side of the assembled holster of the present invention and showing the outer panel, shown in full line assembled to the inner panel shown in broken line and depicting the difference in length of the two panels and the relative location of the belt slots of the panels of the holster; and FIG. 7 is a rear end view of the universal holster or carrier device of the present invention, showing the curved position of the retention projection of the outer panel and showing the snap type fastener device which assists in securing the handgun in position within the holster.

DETAILED DESCRIPTION OF PREFERRED EMBODIMENT

Figure 1:
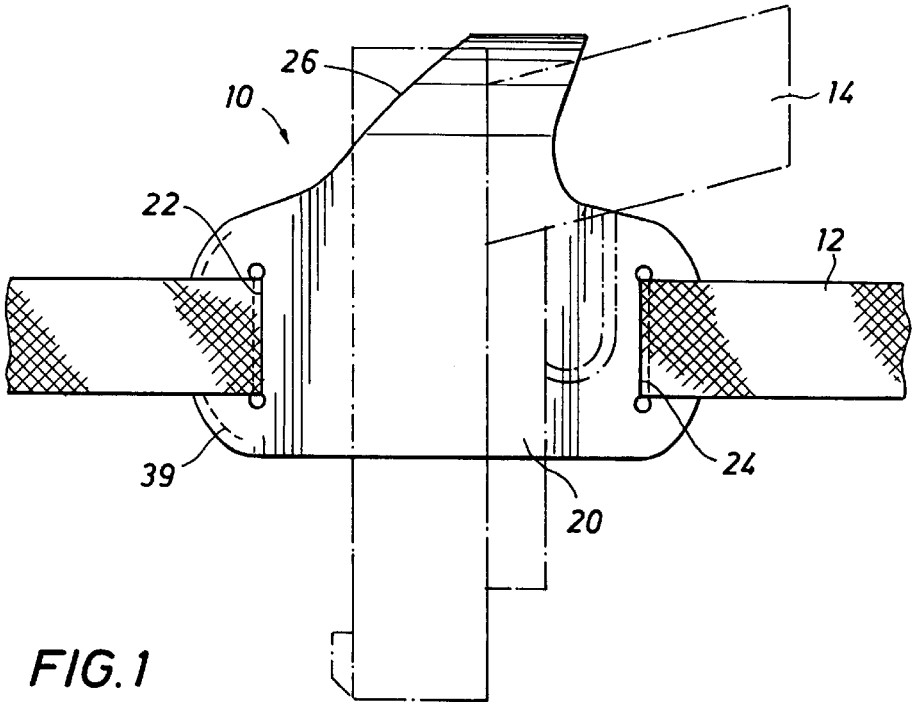
Figure 2:
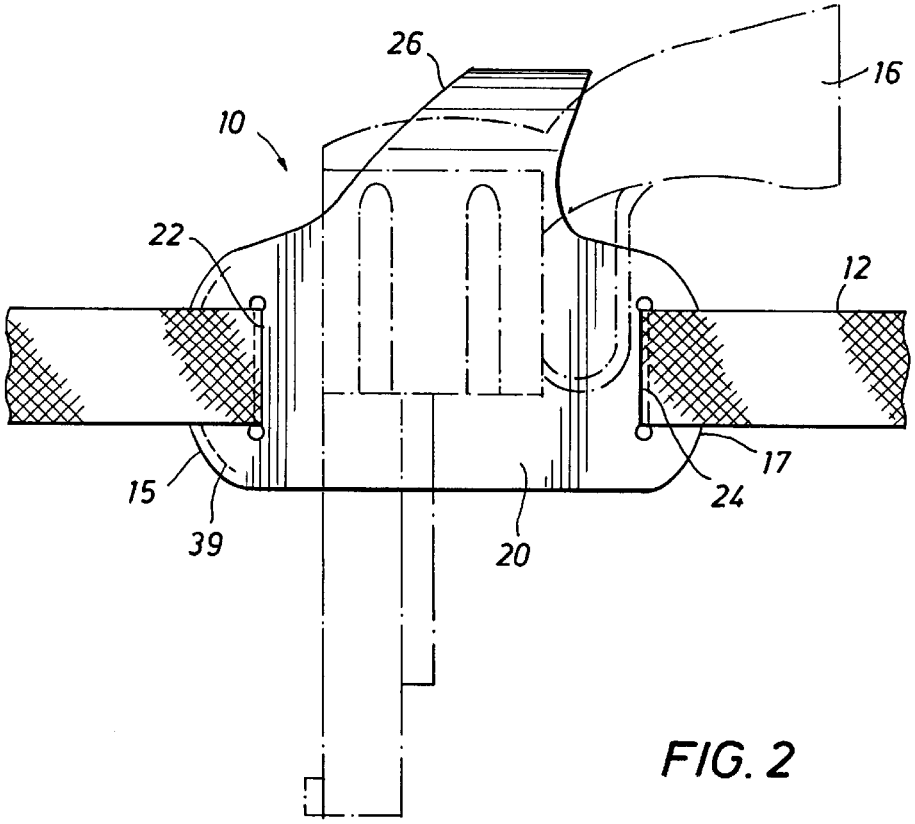

Referring now to the drawings and first to FIGS. 1 and 2, a universal holster constructed in accordance with the present invention and representing the preferred embodiment is shown generally at 10 and is shown in assembly with the waist belt 12 of a user. By way of broken line, FIG. 1 shows a semi-automatic handgun 14 being supported by the holster while FIG. 2 shows a revolver type handgun being supported by the same holster or carrier device 10.

With reference to FIG. 3, there is shown a front or outer holster panel 16 of the holster assembly 10, with the inside or body side surface 18 of the front panel being shown. The front or outer panel 16 defines front and rear ends 17 and 15, respectively. The front panel 16 is preferably formed of leather, but may be formed by any other suitable sheet-like flexible material. The front panel 16 is provided with a body section shown at 20 having belt slots 22 and 24 being defined therein. The upper portion of the front or outer panel 16 defines a handgun retention strap 26 which is in the form of an elongate upstanding projection that is integral with the body section 20. At the upper end of the retention strap 26 is provided fastening means 28 which may conveniently take the form of one section of a snap fastener.

Referring now to FIG. 4, there is shown a back or inner panel 30, with the inside or body side surface 31 of the front panel being shown. The inner or body panel 30 is also preferably formed of leather, but may be formed by any other suitable sheet-like flexible material. The back or inner panel has a body section 32 with front and rear ends 36 and 34 and defining front and rear belt slots 38 and 40 being cut or otherwise defined therein for the purpose of receiving the waist belt 12 of the user as shown in FIGS. 1, 2, 5 and 6. The inner or body panel 30 and the front or outside panel 16 are assembled at the front ends only by stitching 39, leaving the rear end portion of the holster assembly open. A retention projection 42 extends upwardly from the body section 32 and defines a free extremity 44 having a fastening element 46 thereon which is adapted for releasable fastening assembly with the fastener element 28 of the retention strap or projection 26 of the front or outer panel 20. The inner panel 30 also defines a recessed region 48 to which the rear slot 38 is closely spaced and which permits the wearer's waist belt 12 to have maximum unimpeded length between the rear belt slots of the inner and outer panels. It should be borne in mind that the belt slots of the inner and outer panels may be oriented in parallel relation with one another or, if desired, may be oriented in slight angular relation with one another for the purpose of controlling positioning and stabilization of the holster relative to the waist belt and clothing of the user. The three laterally spaced belt slots of the inner and outer holster panels provide significantly greater holster stability as compared to conventional holsters having one or two belt slots or loops for support of the holster and handgun by the waist belt of the user.

With the design of this invention, the handgun is held completely against the body of the user making it extremely difficult for other persons to retrieve the handgun from the holster of the wearer even when significant pulling or jerking force is applied. Tests have shown that it is virtually impossible for a person not wearing the holster of the present invention to pull or jerk the handgun from the holster without first releasing the snap fastener assembly. This is an extremely important feature from the standpoint of law enforcement officers who frequently find themselves in an adversarial relation with others who might try forcing a handgun from the holster of an officer.

With this design also comes the added ease of use in the while being worn in normal walking, standing, or sitting positions, the weight and structure of the wearer adds to the tension of the holster increasing the retainability of the weapon by the holster. However, when the wearer needs to remove the gun from the holster, the simple act of raising the arm and shoulder to grasp the gun in the holster causes the body to elongate thereby releasing some of the mechanical retention pressure on the handgun and thereby allowing it to be withdrawn from the holster much easier and with less resistance than with any other type or design of holstering device. This design allows the wearer's belt to be laced through the belt loop holes in a combination of ways which best fit the positioning of the belt loops on the wearer's trousers. Additionally, the half back piece allows the placement of the weapon into the holster and due to the flexibility allowed by the lack of the full piece back, the width of the holster opening needed to fit each individual model of manufactured handgun can be adjusted accordingly by tightening or loosening the wearer's belt. The looser the belt is, the wider the opening between the front side and the back side of the holster is, therefore the larger the weapon that can be fitted into the holster. Also positive to the design is that the lack of a solid panel of leather between the weapon and the belt and body of the wearer allows it to be carried virtually against the hip of one's torso making the concealability factor high.

A principal advantage is that only one holster is needed for use with a multitude of handgun weapons as opposed to the previously manufactured designs which have only a limited application for each type and/or caliber of handgun. This invention is unique in that the holster assembly has three belt loops through which the wear's belt must be laced, as opposed to one or two on all other types and designs of holsters. This feature provides the holster assembly with an open-body concept unique to this holster only. The construction of the body is unique due to the fact that although constructed of two pieces of material, they are only sewn or attached together at one end of the assembled holster structure, that being the front or forward most edge of the joinder of the inner and outer holster panels. The inner panel is intentionally made smaller than the outer panel, as described and illustrated in detail herein.

The front, or outside panel of material is elongated along a horizontal line. On the top edge of the outer panel is provided an extended piece or strap of the material which angles up and forward much like a finger and functions as a retention strap which extends over the upper portion of a handgun seated within the holster and secures the handgun against upward extraction movement. In the upper end of this finger or retention strap is set the male or inserting portion of a metal snap fastener. On either end portion of the elongated body portion, and perpendicular to the place of the elongation is a slit in the material through which the wearer laces or inserts their belt.

The back, or wearer's body side, panel of material is also elongated along a horizontal axis. It is cut shorter than the outer piece. Extending from this panel is also a projection or finger. In the upper end of this structure is set the female, or receiver, portion of a metal snap fastener. At opposing ends and perpendicular to the elongation of the main body of this inner or back panel are belt slots, the same size as those in the outer panel. The two, outer and inside, panels are joined together at the front end of the structures, preferably by stitching, but may be secured together by brads or by any other suitable means. The belt slots of the front edges of the outer and inner panels are aligned to match or coincide and are then sewn or otherwise joined, forming a double thickness of material and creating the front of the holster. This feature enhances the structural integrity of the front end of the holster assembly. The remaining edges of the outer and inner panels are not attached to each other thus providing the holster assembly with an "open holster" concept, as seen from a top view of the sewn holster body pieces and as shown in FIG. 7.

To assemble the holster and waist belt, the wearer will lace the waist belt through the belt slots as illustrated in FIGS. 1, 2, 5 and 6. The belt, once fastened, completes the open space of the holster back, or wearer's body side, panel of the holster, and becomes an integral part of the holster. When tightened to wearer tension, the wearer's belt causes pressure on the double thickness of material in the front, the middle slot located in the back or inner panel, as well as the third slot located in the back or rear portion of the outer panel. The holster is now fastened to the wearer's body in three places as opposed to the conventional two places of other holsters. Other holsters which have more than two belt loops still only have those belt loops in the opposing ends only as opposed to one in the front, one in the middle, and one in the rear portions of the structure's body.

With the holster in place on the belt, the wearer will insert a handgun between the front panel and the back panel/belt combination panel. The extended "Finger" on the outer holster body panel is now folded over the top of the handgun. This causes the top edge of the finger to become angled towards the rear where the two snap fastener elements interface to complete the security fastening device, or retention strap as it is commonly referred to.

To release the retention strap the wearer need only to place a hand on the butt, or rear, of the handgun. With the thumb of that hand the wearer will push downward in the joinder of the retention straps and the male and female snap fastener pieces. The resulting thumb pressure forces the panels apart, releasing the retention strap, and allowing the handgun to be drawn up and out of the holster for use.

The construction of this invention has many advantages over conventional holster construction. With the belt laced through the three belt loops, or slots, in this holster, it fastens to the wearer's body in such as fashion that a middle belt loop, which is defined by the inner panel and is located at or near the middle of the outer panel, i.e., between the front and rear belt slots of the outer panel, acts as a "Stabilizer" or pivot point. This feature us unique to the "open holster" concept of the present invention and has not been accomplished with any other handgun holster design. If the wearer utilizes a belt which is smaller in width than the length of the belt loops or slots, this "Stabilizer" slot acts to reduce the rocking of the holster on the belt by 90 to 95 percent, which has never been achieved with any other holster. Likewise, this "Stabilizer" loop also acts to pull the center of the holster, where the weight of the handgun is, into the wearer's body where it rides the contour of their body at the hip. This is the only holster which features this design to reduce the outward flop of the handgun away from the wearer's body.

The holster will also accommodate a majority of all the handguns available. It is able to do this because not being a preformed structure that is designed to form a pouch to receive a handgun of a specific type and size, the rearward slot in the outer body piece allows that piece to slide forward or backward on the wearer's belt. When handguns of varying size frames and/or configurations are placed into the holster interior, the rear panel slides on the wearer's belt to accommodate the mass of the handgun frame as the sides of the holster are spread apart. The placement of the rear slot, or belt loop, within the body of the outer panel, is crucial to the proper operation of the holster as it will only allow the various handguns to fit only a predetermined depth.

The placement and positioning of the fastening snap panels on the inner and outer body panels is also crucial due to the fact that if not properly placed, it would not provide the proper amount of retention should a person other than the wearer attempt to remove the handgun from the holster.

The placement of the snap on this holster is such that tests have proven that even if two persons, other than the wearer, were to pull on the handgun at the same, time, the snap and retention device will still hold the handgun securely in place until the snap pieces are separated by the wearer as described above, thereby providing an unequaled amount of weapon retention security.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

What is claimed is:

1. A universal waist belt supported carrier for firearms, comprising:

(a) a first panel having front and rear ends and defining front and rear belt slots;

(b) a second panel defining front and rear ends and further defining front and rear belt slots, said first and second panels being joined only at said front ends thereof, and (c) said front and rear belt slots of said first and second panels adapted to receive a waist belt being threaded therethrough for defining a closure said rear ends of said first and second panels (d) firearm retainer means projecting from said first and second panels and being releasably fastenable to retain a firearm within said universal waist belt supported carrier.

2. The universal waist belt supported carrier of claim 1, wherein:

(a) firearm retainer elements on said first and second panels and being releasably fastened to retain a firearm within said universal waist belt supported carrier; and (b) stitching extending through said first and second panels at said front ends thereof and establishing said joined relation thereof.

3. The universal waist belt supported carrier of claim 1, wherein:

(a) said first panel being an inner panel adapted for contact with the wearing apparel of the user;

(b) said second panel being an outer panel of greater length than said inner panel; and (c) said rear belt slot of said inner panel being located intermediate said front and rear belt slots of said outer panel.

4. The universal waist belt supported carrier of claim 1, wherein:

said belt slots of said first and second panels receiving the waist belt in a manner threaded through said front belt slots of said first and second panels, through said rear belt slot of said first panel and then through said rear belt slot of said second panel.

5. The universal waist belt supported carrier of claim 2, wherein said firearm retainer elements comprising:

(a) a first retainer projection being defined on said first panel;

(b) a second retainer projection being defined by said second panel; and (c) releasable fastener elements being provided on said first and second retainer projections and adapted for releasably interconnecting said first and second retainer projections for retaining a firearm secured by said universal waist belt supported carrier.

6. The universal waist belt support carrier of claim 5, wherein:

(a) said second panel being an outer panel; and (b) said second retainer projection projecting upwardly from said outer panel and being oriented in forwardly inclined relation with a waist belt position established by said front and rear belt slots of said panels.

7. The universal waist belt supported carrier of claim 1, wherein:

(a) a first retainer projection extending upwardly from said first panel and adapted for positioning against the wearing apparel of the user;

(b) a second retainer projection extending upwardly from said second panel and being of greater length than said first retainer projection and adapted to be bent over the upper portion of a firearm seated within said universal waist belt supported carrier for retaining a firearm in secured relation between said first and second panels; and (c) fastening elements being provided on said first and second retainer projections and adapted for releasable fastening assembly for securing said second retainer projection about an upper portion of a firearm.

8. The universal waist belt supported carrier of claim 7, wherein:

said fastening elements comprising snap-type releasable fastener elements.

9. The universal waist belt supported carrier of claim 7, wherein said fastening elements comprising:

(a) a female snap fastener element being fixed to said first retention projection; and (b) a male snap fastener element being fixed to said second retention projection and adapted for releasable snap fastening with said female snap fastener element.

10. The universal waist belt supported carrier of claim 7, wherein:

said second panel being an outer panel, said second retainer projection extending upwardly form said outer panel and being oriented in forwardly inclined relation with a waist belt position established by said front and rear belt slots of said first and second panels.

11. A universal waist belt supported carrier for firearms, comprising:

(a) an inner panel composed of flexible sheet-like material and having front and rear waist belt slots;

(b) a retainer element being integral with and extending upwardly from said inner panel;

(c) an outer panel composed of flexible sheet-like material and having front and rear waist belt slots, said front waist belt slots of said inner and outer panels being in registry and said rear waist belt slots of said inner and outer panels being offset from one another;

(d) a retainer strap being integral with and extending upwardly from said outer panel and adapted to be bent over the upper portion of a firearm for securing the firearm against upward movement relative to said carrier;

(e) releasable fasteners being fixed to said retainer element and said retainer strap for releasably securing said retainer strap to said retainer element when said retainer strap is bent over the upper portion of a firearm; and (f) means securing the front portions of said inner and outer panels in fixed assembly.

12. The universal waist belt supported carrier of claim 11, wherein:

said securing means being stitching thread joining said first and second panels only at said front ends thereof.

13. The universal waist belt supported carrier of claim 11, wherein:

(a) said inner panel being adapted for contact with the wearing apparel of the user;

(b) said outer panel being of greater length than said inner panel; and (c) said rear belt slot of said inner panel being located intermediate said front and rear belt slots of said outer panel.

14. The universal waist belt supported carrier of claim 11, wherein:

said registering front belt slots of said first and second panels and said offset belt slots of said inner and outer panels being oriented so that a waist belt of the user will be threaded through said registering front belt slots of said inner and outer panels, through said rear belt slot of said inner panel and then through said rear belt slot of said outer panel.

15. The universal waist belt supported carrier of claim 11, wherein:

said rear waist belt slot of said inner panel being located intermediate said registering front belt slots of said inner and outer panels and said rear waist belt slot of said outer panel and establishing a stabilizer point substantially centrally of said universal waist belt supported carrier so that the intermediate portion thereof is secured to the body of the user by a waist belt threaded through said belt slots.

16. The universal waist belt support carrier of claim 11, wherein:

said retainer strap projecting upwardly from said outer panel and being oriented in forwardly inclined relation with respect to a waist belt position established by said registering front belt slots of said inner and outer panels and said rear waist belt slot of said outer panel.

17. The universal waist belt supported carrier of claim 11, wherein:

(a) said retainer element of said inner panel adapted for positioning against the wearing apparel of the user;

(b) said retainer strap extending upwardly from said outer panel and being of greater length than said retainer element and adapted to be bent over the upper portion of a firearm seated within said universal waist belt supported carrier for retaining the in secured relation between said inner and outer panels; and (c) fastening elements being provided on said first and second retainer element and retainer strap and adapted for releasable fastening assembly for securing said retainer strap about an upper portion of a firearm secured between said inner and outer panels.

18. The universal waist belt supported carrier of claim 17, wherein:

said fastening elements comprising snap-type releasable fastener elements.

19. The universal waist belt supported carrier of claim 17, wherein said fastening elements comprising:

(a) a female snap fastener element being fixed to said retainer element; and (b) a male snap fastener element being fixed to said retainer strap and adapted for releasable snap fastening with said female snap fastener element to secure said retainer element and said retainer strap in releasable connection.

20. The universal waist belt supported carrier of claim 17, wherein:

said retainer strap projecting upwardly from said outer panel and being oriented in forwardly inclined relation with respect to a waist belt position established by said registering front belt slots of said inner and outer panels and said rear waist belt slot of said outer panel.

* * * * *

UNITED STATES PATENT AND TRADEMARK OFFICE

CERTIFICATE OF CORRECTION

PATENT NO. : 6,283,351 B1
DATED : September 4, 2001
INVENTOR(S) : Ray M. Brite

It is certified that error appears in the above-identified patent and that said Letters Patent is hereby corrected as shown below:

Column 5,
Line 4, delete "38", insert -- 39 --

Column 7,
Line 19, delete "us", insert -- is --

Column 8,
Line 14, after "closure", insert -- at --.
Line 17, delete "fastenable", insert -- fastened --

Column 10,
Line 31, after "panel", insert -- being --

Signed and Sealed this

Twenty-eighth Day of May, 2002

*Attest:*

*Attesting Officer*

JAMES E. ROGAN
*Director of the United States Patent and Trademark Office*